United States Patent [19]

Merrien

[11] Patent Number: 4,726,414

[45] Date of Patent: Feb. 23, 1988

[54] LOW-PRESSURE ISOSTATIC CASTING PROCESS AND MACHINE

[75] Inventor: Pierre L. Merrien, Billere, France

[73] Assignee: Etude et Developpement en Metallurgie (S.A.R.L.), Serres Castet, France

[21] Appl. No.: 872,849

[22] Filed: Jun. 11, 1986

[30] Foreign Application Priority Data

Jun. 18, 1985 [FR] France ..... 85 09423

[51] Int. Cl.[4] ..... B22D 18/00

[52] U.S. Cl. ..... 164/119; 164/257; 164/285; 164/309

[58] Field of Search ..... 164/119, 113, 155, 254, 164/285, 309, 306, 257, 256, 56.1, 62, 66.1

[56] References Cited

U.S. PATENT DOCUMENTS 4,526,222 7/1985 Itelg ..... 164/119
4,550,763 11/1985 Nikolov ..... 164/119

FOREIGN PATENT DOCUMENTS 7917317 9/1983 France .
55-136555 10/1980 Japan ..... 164/62
417237 8/1974 U.S.S.R. ..... 164/62
603493 4/1978 U.S.S.R. ..... 164/300

*Primary Examiner*—Nicholas P. Godici
*Assistant Examiner*—G. Reid
*Attorney, Agent, or Firm*—Sandler & Greenblum

[57] ABSTRACT

In this low-pressure casting process a mold is filled from the bottom with a liquid metal or alloy contained in a hermetically sealed furnace. The metal or alloy is forced into the mold through an injection tube by a pressurized fluid. A crucible containing the metal or alloy in the furnace is separated from electrical heating elements and thermally insulative parts by a sealed metal inner jacket supporting the crucible. Fluid is fed from the side of the inner jacket opposite the crucible throughout the casting operation, until the cast part has solidified. The pressure of this fluid is varied according to the pressure above the surface of the metal or alloy in the crucible, so as to maintain a pressure balance at all times between the inside and the outside of the inner jacket.

12 Claims, 4 Drawing Figures

LOW-PRESSURE ISOSTATIC CASTING PROCESS AND MACHINE

BACKGROUND OF THE INVENTION

1. Field of the Invention

The present invention concerns a new low-pressure casting process intended in particular to enable the same installation to be used for casting alloys under highly diverse conditions, in particular alloys of aluminum and magnesium.

2. Description of the Prior Art

The low-pressure casting process has been known since the beginning of this century. Using this technique:

a metal or otherwise mold is filled from the bottom with a liquid alloy contianed in a hermetically sealed furnace; the alloy may rise into the mold through an injection tube;

filling of the mold is achieved with the aid of a fluid at a pressure of a few decibars;

after the mold is filled, a deadhead overpressure is maintained while the part solidifies;

the non-solidified alloy in the injection passages in the bottom of the mold is recovered as soon as the part has solidified and after the injection pressure is removed.

The molds employed may be permanent (in which case they are fabricated in cast iron or steel or graphite) or non-permanent in which case they are destroyed after casting to release the part. Such non-permanent molds are fabricated from chemical sand, ceramic or plaster.

The alloys used are generally those of aluminum, applications in the automobile industry being of particular importance, and also those of magnesium and copper (brass, bronze). Significant developments are currently in progress in connection with cast iron and steel.

In the case of aluminum alloys the gas used to pressurize the furnace is generally air, although it may be nitrogen to avoid oxidation of the surface. The manufacture of the aluminum alloy and operation in air may introduce hydrogen into the alloy because of the moisture content of the fusion product, the ambient air and the air fed into the furnace. It is therefore necessary to degas the metal at the end of manufacture and during casting.

This operation may be done by chemical agents (special fluxes, chlorine, nitrogen, etc) or by applying a vacuum of a few millibars to the surface. In this case it may be beneficial to generate the vacuum in the low-pressure casting furnace.

In order to avoid interrupting casting for this vacuum degassing to take place it is possible to use two furnaces, one being used for casting and the other for degassing and taking over from the first when it is empty. To this end the two furnaces are movable on rails.

Mobile furnaces are known in the art and there also exist low-pressure furnaces for casting aluminum designed to withstand a vacuum. The pressure-tight outer jacket is also vacuum-tight. One disadvantage of this approach is that the refractory and insulative block supporting the furnace elements and thermally insulating the furnace are exposed to the vacuum. This block is porous and contains a significant quantity of gas and even of moisture, and it has to be maintained continuously at a temperature in excess of 80°/100° C. after a long drying time, several days before it is put into service for the first time. Also, these materials are often fibrous or powdery and are sucked in by the vacuum pumps.

These disadvantages, associated with the fact that sealing is provided by the outer jacket, are compensated by the fact that this jacket runs cool (50° to 80° C.) as it is protected from the elements by the insulating material and is therefore not subjected to thermal fatigue stresses during each pressurization cycle. These stresses would otherwise require significant reinforcing of the structure. Likewise, applying a vacuum to a jacket at high temperature would produce deformations in the absence of appropriate reinforcements. Because of this an open plate is all that is placed before the elements, in order to protect them mechanically.

Low-pressure casting machines with provision for vacuum casting of aluminum are therefore of this type, with a single sealed jacket on the outside of the furnace, as shown in FIG. 1 in the appended drawings.

FIG. 1 shows a sealed outer jacket 1, a fixed lid 2 attached to this jacket, a mobile lid 3, elements 4, refractory members 5 supporting the elements, insulators 6, a protective plate 7 open at the bottom, a crucible 8, a metal 9, an injection tube 10, a pressurizing air inlet 11, a depressurizing air intake 12, a vacuum air offtake 13, an outlet 14 for evacuating the metal should the crucible break, lid insulation 15, seals 16 and 17, a connecting nozzle 18, a fixed plate 19 of the casting machine and a mold 20.

In the case of magnesium alloys, however, this device cannot be used since the gas employed to inject the magnesium must not bring about any oxidation of the metal, the currently known solution being to use sulphur hexafluoride (SF6) diluted to 0.5 to 1% in air or carbon dioxide.

This gas is a fluoride and decomposes the refractory and insulating material, however, as these are generally based on silica compounds (silica-alumina in particular). It is therefore necessary to protect the refractory materials from the SF6 and a low-pressure casting machine for magnesium has to have a sealed inner jacket that can serve as the crucible to contain the metal.

FIG. 2 is a diagram of a machine of this kind, showing an outside jacket 1' of the furnace which no longer as any sealing function, a crucible 2' containing the magnesium, a lid 3', elements 4', refractory materials 5', insulating materials 6', molten magnesium alloy 7', an injection tube 8', a special injector nozzle 9' with provision for protective gas, an inlet 10' for feeding the gas based in diluted SF6 into the connecting nozzle, an inlet 11' for feeding SF6 into the furnace to move the metal, a decompression gas outlet 12', a seal 13', a fixed plate 14' of the machine and a mold 15'.

In a furnace of this kind the crucible 2' contains the metal at approximately 750° C. and its outer wall is heated by the elements. During each cycle it is subjected to thermal fatigue stresses and is internally pressurized, generally to a pressure of 0.6 to 1 bar. These stresses combine with the risks of corrosion which can only be limited in the case of dilute SF6 by using high-chromium steel. This leads to very thick crucibles (up to 20 mm) which are costly, difficult to handle and somewhat dangerous to use.

Note, however, that magnesium alloys are not subjected to vacuum degassing as they vaporize at significant pressures, often in the order of 60 millibars.

These factors are such that current low-pressure casting machines for aluminum and for magnesium are different, while in both cases the solutions adopted for depressurizing the aluminum and pressurizing using dilute SF6 are unsatisfactory.

Foundries which cast parts of the aerospace industries use both aluminum alloys and magnesium alloys and these parts, which are generally large, thin and of high metallurgical quality, are typical applications of low-pressure casting.

An object of the present invention is therefore to define the structure of a new type low-pressure casting machine capable of supporting:

vacuum in the order of 1 millibar;

pressures up to 2 bars;

various non-corrosive gases such as air or nitrogen and corrosive gases such as SF6;

and all this without being exposed to thermal fatigue stresses during pressurization or to creep forces due to suction when the vacuum is applied.

SUMMARY OF THE INVENTION

In one aspect, the present invention consists in a low-pressure casting process in which a mold is filled from the bottom with a liquid metal or alloy contained in a hermetically sealed furnace, said metal or alloy being forced into said mold through an injection tube by a pressurized fluid, in which process a crucible containing said metal or alloy in said furnace is separated from electrical heating elements and thermally insulative parts by a sealed metal inner jacket supporting said crucible, fluid is fed from the side of said jacket opposite said crucible throughout the casting operation until the cast part has solidified, and the pressure of said fluid is varied according to the pressure above the surface of the metal or alloy in said crucible so as to maintain a pressure balance at all times between the inside and the outside of said jacket.

Using this process it is possible to maintain a pressure balance between the inside and outside of the inner jacket:

irrespective of the level of the metal or alloy in the crucible;

irrespective of the state of progress of the casting cycle, and therefore even for high pressures during the overpressure phase;

irrespective of the sign of the pressure relative to atmospheric pressure, in other words whether the crucible is pressurized or depressurized.

Specifically, it is possible to retain a residual pressure greater than atmospheric pressure between two casting operations in order to retain the metal in the upper part of the injection tube so as to avoid the formation of oxides due to the lowering and re-raising of the metal in the tube.

In another aspect, the invention consists in a low-pressure casting machine for implementing a low-pressure casting process in which a mold is filled from the bottom with a liquid metal or alloy contained in a hermetically sealed furnace, said metal or alloy being forced into said mold through an injection tube by a pressurized fluid, in which process a crucible containing said metal or alloy in said furnace is separated from electrical heating elements and thermally insulative parts by a sealed metal inner jacket supporting said crucible, fluid is fed from the side of said jacket opposite said crucible throughout the casting operation until the cast part has solidified, and the pressure of said fluid is varied according to the pressure above the surface of the metal or alloy in said crucible so as to maintain a pressure balance at all times between the inside and the outside of said inner jacket, said machine comprising a sealed outer furnace jacket, a crucible inside said jacket for containing said metal alloy, electrical heating elements and refractory and thermally insulative elements surrounding said crucible, a movable lid on said crucible, a casting nozzle on said lid, means for pressurizing or depressurizing the space above the surface of said metal or alloy in said crucible, also on said lid, a metal inner jacket fixed in fluid-tight manner to a frame of said furnace supporting said crucible and isolating it in fluid-tight manner from said heating, refractory and insulative elements, means for establishing communication between the outside of said metal inner jacket and either a source of pressurized fluid or a vacuum, said communication establishing means incorporating valve means, regulator means controling said valve means connected to said means for pressurizing or depressurizing said space above said metal or said alloy in said crucible, and pressure sensors in said furnace, on both sides of said metal inner jacket, connected to said regulator means.

Other objects and advantages will appear from the following description of an example of the invention when considered in connection with the accompanying drawings and the novel features will be particularly pointed out in the appended claims.

DESCRIPTION OF THE PREFERRED EMBODIMENT

Figure 1:
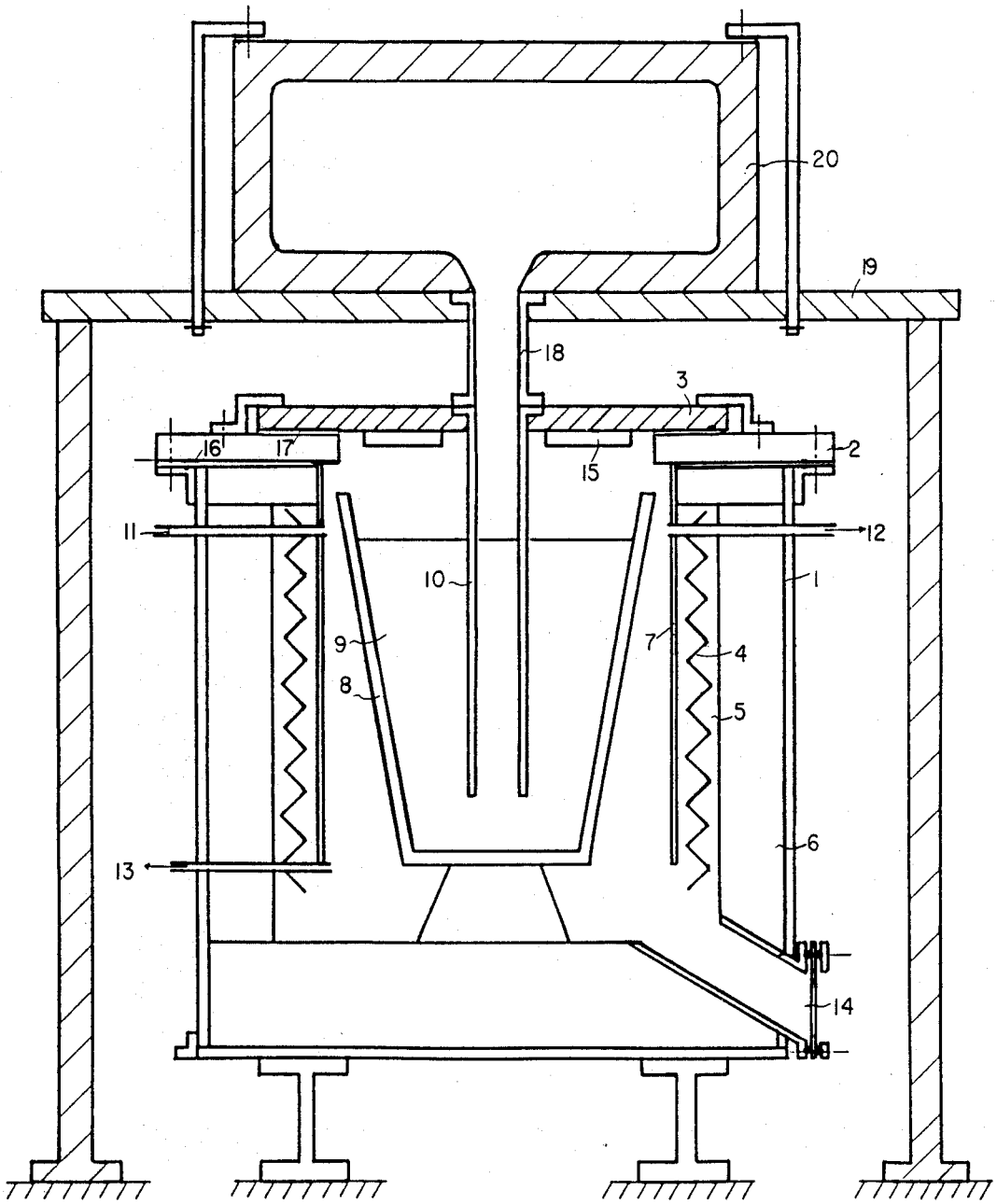
FIG. 1. PRIOR ART
FIGS. 1 and 2 are diagrams showing prior art casting machines.
Figure 2:
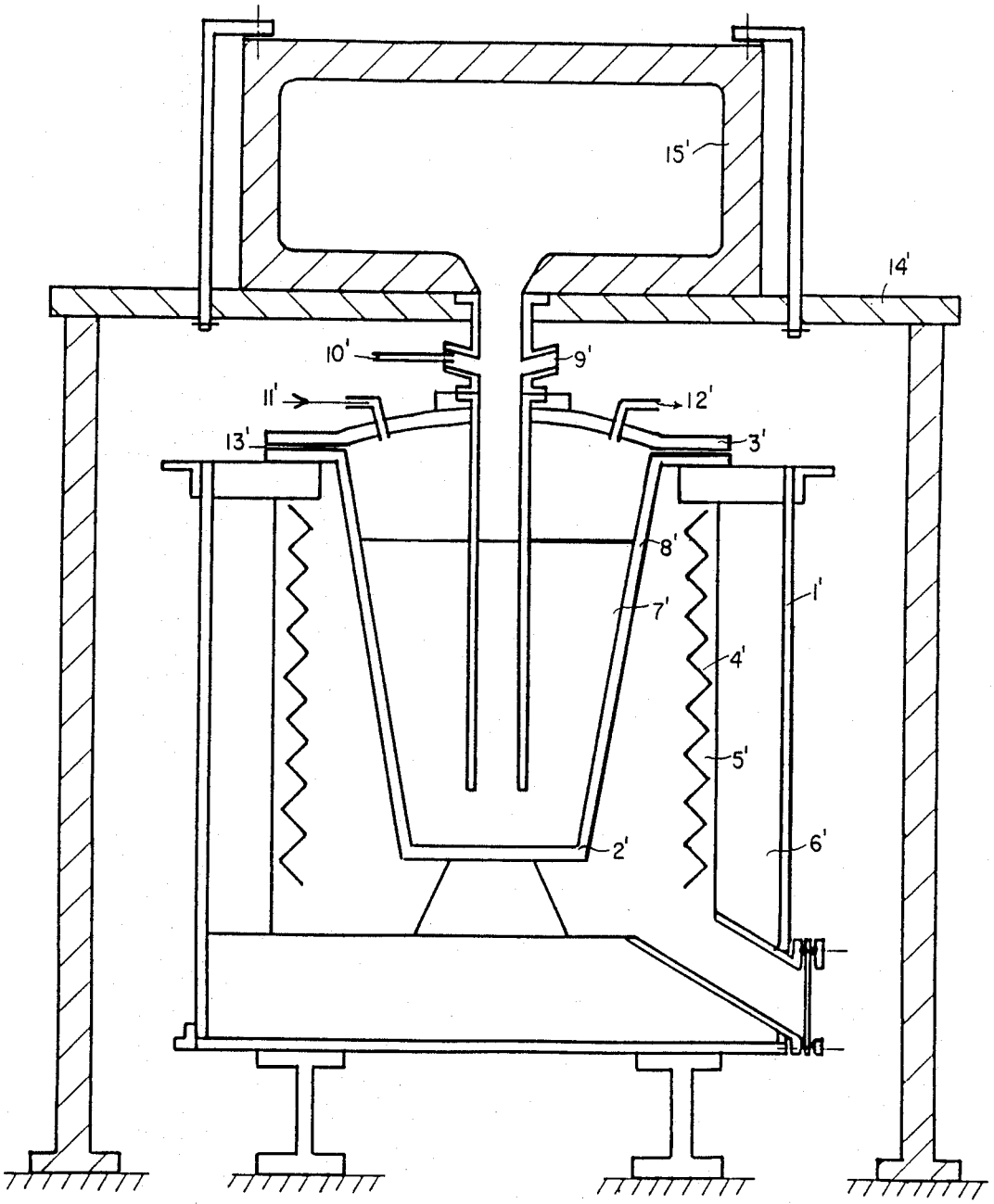
FIG. 2. PRIOR ART
Figure 3:
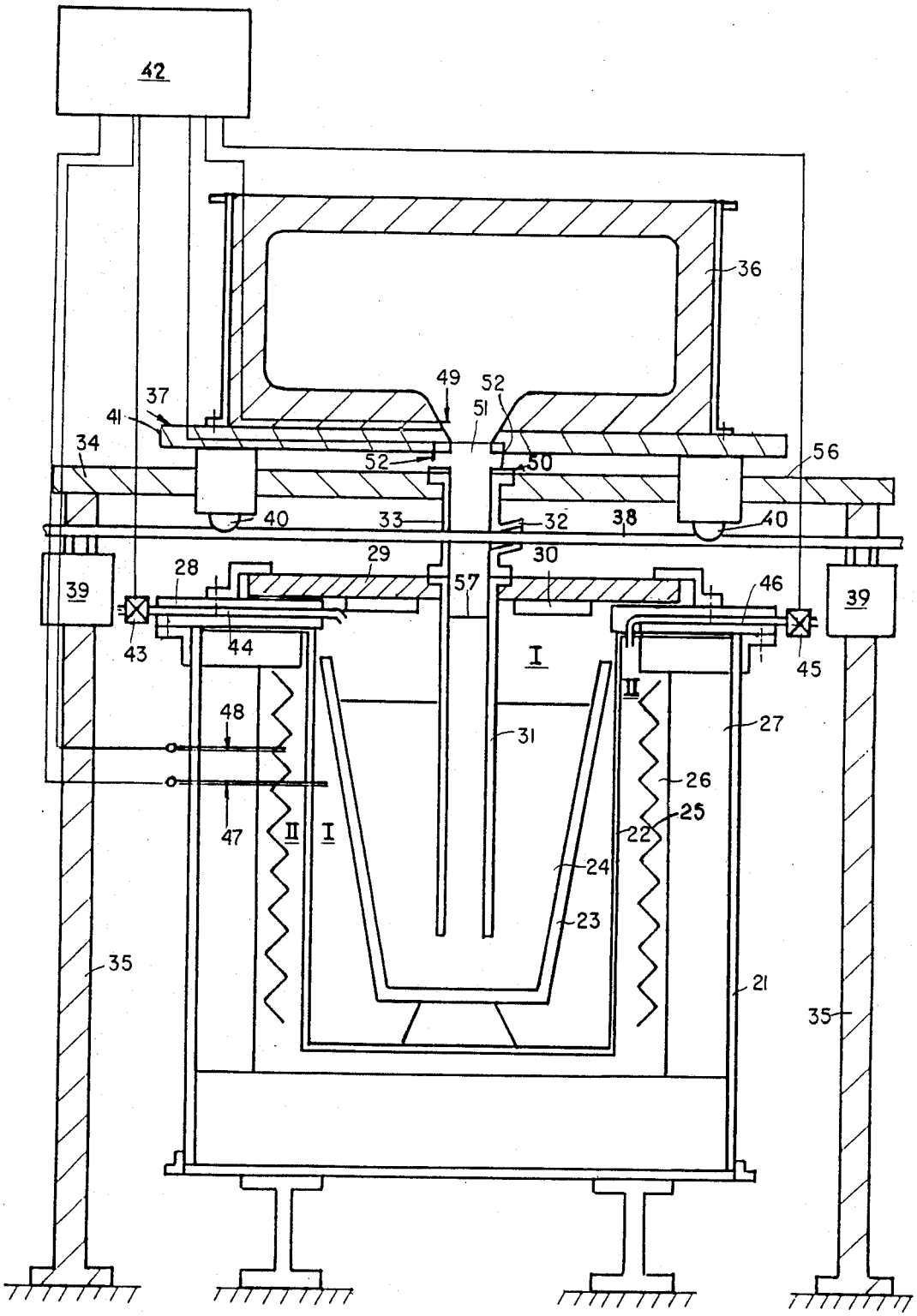
FIGS. 3 and 4 are respectively a schematic view in cross-section of a casting machine with mobile molds and a view in elevation and axial vertical half-section of a machine as shown in FIG. 3.

FIG. 3 shows the outer jacket 21 of a furnace which is fluid- and vacuum-tight. Inside the furnace, supported by a sealed inner jacket 22, is a crucible 23 of graphite or silicon carbide in the case of aluminum or of steel in the case of magnesium containing the molten metal 24 (aluminum or magnesium alloy). The inner jacket 22 is of chrome steel resistant to corrosion by SF6.

The electrical heater elements 25 are disposed externally of the jacket 22, together with the refractory materials 26 and thermally insulative materials 27.

The lid of the furnace consists of a fixed annular lid 28 joined to the outer jacket 21; the part in contact with the SF6 is in chrome steel; a disk-shaped mobile lid 29 in chrome steel is removably fixed to the annular lid 28. The lid 29 is lined with an insulative material 30.

An injection tube 31 passes through the lid 29, dips into the liquid metal 24 in the crucible and ends at the top in a connection nozzle (32 for magnesium, 33 for aluminum).

Over the furnace is fixed horizontal table 34 supported by four pillars 35 over the top of which may be moved a mold 36 carried by a carriage 37 travelling on two parallel rails 38 disposed horizontally one on each side of the fixed table 34.

Figure 4:
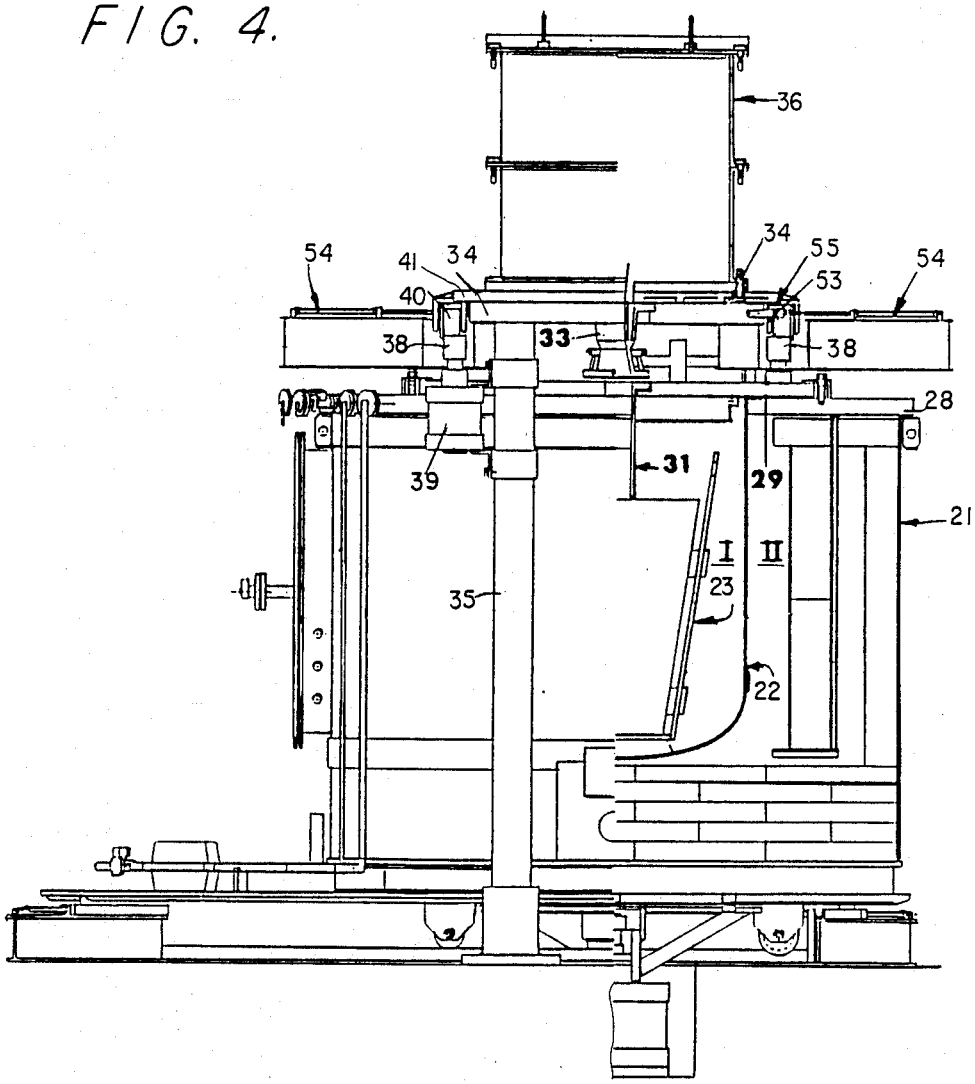

As can be seen in more detail in FIG. 4, which shows an industrial implementation of the machine schematically represented in FIG. 3, the rails 38 are supported by the piston rods of four hydraulic actuators 39 disposed vertically and fixed to console brackets attached to the four pillars 35 supporting the table 34.

FIG. 4 shows the wheels 40 of the mold-support carriage 37 running on the rails 38 and fixed laterally to the bottom plate 41 on which the mold 36 rests.

A regulator or control device symbolicaly shown at 42 in FIG. 3 is responsible for controling and coordinating the pre-casting operations, the casting operations proper and the post-casting operations.

To this end the device 42 is connected to a valve 43 inserted into an inlet pipe for a gas for pressurizing the space I above the liquid in the crucible 23 (or for depressurizing this space). Communication with the space I is established through a passage 44 formed in the thickness of the fixed annular lid 28. In practise there are three such passages 44 (and three corresponding valves 43) respectively assigned to feeding said pressurizing gas, extracting it and depressurizing the space concerned.

The device 42 is connected to a valve 45 controling the entry and exit of the gases for pressurizing (or depressurizing) the space II between the inner jacket 22 and the outer jacket 21. Communication with the space II is established by a passage 46 formed in the thickness of the annular lid 28.

As with the space I there are in practise three separate assemblies 45–46 for admitting and removing the gas and for depressurizing the space concerned.

The device 42 is also connected to a pressure sensor 47 in the space I and to a pressure sensor 48 in the space II.

In line with the bottom inlet orifice to the mold 36 is a sensor 49 adapted to detect the passage of the metal, which may consist for example of an insulated metal wire bared at the end and connected to the regulator device 42.

The upper end of the casting nozzle 33 is fitted with an asbestos washer 50 adapted to be disposed between the nozzle and the orifice 51 by means of which the liquid metal passes through the plate 41 supporting the mold 36.

One on each side of the orifice 51 are two sensors 52 connected to the device 42 and adapted to indicate to the device 42 that the mold 36 is placed above the casting nozzle 33 correctly and in fluid-tight manner.

In the embodiment shown in FIGS. 3 and 4, since it is a matter of casting aluminum, it is the nozzle 33 that is used.

The sensors 52 each comprise, for example, a conductive spike projecting from the lower surface of the plate 41, inserted into an insulative bush and connected by an insulated wire to the device 42. These spikes are able to pass through the thickness of the asbestos 50 and, on contacting the underlying metal nozzle 33, send an electrical signal to the device 42.

This device is connected to a device for locking the mold support carriage 37 in the casting position, consisting (see FIG. 4) of horizontal pins 52 disposed to either side of the table 34 and at right angles to it. The pins 53 are moved by actuators 54 or other displacement means mounted on supports attached to the table support frame. In the position with the carriage 37 locked above the furnace, the pins 53 are inserted through holes in lateral angle irons 55 attached to the plate 41 of the carriage and centering holes in the edge of the table 34.

The device 42 directs the movement of the carriage 37 according to the information from the sensors 56 (which may be spring blade contactors, for example) fixed to the table 34 and to the rails.

To begin injecting the metal, and thus to begin pressurizing the spaces I and II, the mold 36 must be closed and sealed to the casting nozzle 33.

When the carriage 37 is vertically above the casting tube the actuators 39 are lowered and the carriage is applied to the casting nozzle 33. The device 42 locks the carriage and the mold to the table 34 of the machine by means of the actuators 54 and the pins 53; the sensors 52 advise the device 42 that application and therefore sealing have been achieved.

The device 42 then initiates casting as described below by directing pressure into the two enclosures I and II.

Immediately the order is given to begin casting, the device 42 opens the valves 43 and 45 to admit gas into the two enclosures I and II. The device 42 may be of the same type as described in French Pat. No. 79 17317 or in French Pat. No. 82 00115 and may comprise a microprocessor, a memory system and an input/output system. In response to the readings of the pressure sensors 47 and 48 it opens and closes the valves 43 and 45 so as to maintain equal pressures in the two enclosures I and II.

When the metal reaches the level of the sensor 49 the device 42 records the pressure in each enclosure I and II as a zero reference and then alters the pressures above this reference according to the indications memorized in the device 42.

During this pressurization phase the inside and outside walls of the jacket 22 are at the same pressure and thus not subjected to any expansion stresses due to the pressure.

Its mechanical function is to support the weight of the crucible 23 and of the metal 24, which represents a static load.

The same applies on depressurization, the device 42 giving orders to open or close the gas output valves which are in the same configurations as the valves 43 and 45. Depressurization is also controled by the device 42 so as to maintain a balanced pressure on both sides of the jacket 22.

When the residual pressure reaches a value calculated by the device 42 according to the pressure recorded when the metal passes the sensor 49 and the weight of metal cast to produce the part obtained, the device 42 maintains this value so that the metal remains at a constant level 57 in the upper part of the tube 31. This prevents the metal dropping in the injection tube 31, towards the crucible, which would otherwise entail the formation of oxides which could be carried towards the part when the metal rises in the tube again for the next casting.

When the metal is exposed to a vacuum for degassing it the passages 44 and 46 are connected to pumping curcuits which establish a vacuum in the two enclosures I and II. The pressure sensors 47 and 48 feed information to the device 42 which opens and closes the valves 43 and 45 so as to maintain the same pressure on both sides of the inner jacket 22. This avoids deformation of this jacket by "suction" forces.

In the case of permanent molds the device 42 obviously has no need to control the application and sealing of the mold to the casting nozzle.

The machine shown in FIGS. 3 and 4 is equally usable for casting aluminum alloys as described hereinabove and for casting magnesium alloys. In the case of aluminum the gas fed into the enclosure I is air or nitrogen and in the case of magnesium it is sulphur hexafluoride. In both cases the gas fed into the enclosure II may be air.

It will be understood that various changes in the details, material and arrangements of parts which have been herein described and illustrated in order to explain the nature of the invention may be made by those skilled in the art within the principle and scope of the invention as expressed in the appended claims.

There is claimed:

1. A low-pressure casting process comprising:

(a) providing a crucible containing metallic substance in a hermetically sealed furnace and a mold for receiving said metallic substance located outside said furnace, said mold communicating with said crucible by means of a conduit having one end positioned within said crucible and another end opening into said mold, said furnace being divided by a sealing metal inner jacket supporting said crucible wherein said sealing metal jacket divides said furnace into two spaces, said crucible located in a first space and said electrical heating elements and thermally insulative parts located in a second space;

(b) introducing a pressurized first fluid into said first space to force said metallic substance through said conduit and into said mold in a manner so that said fluid is introduced from a side of said jacket opposite said crucible throughout the casting operation until the cast product has solidified;

(c) varying a pressure of a second fluid in said second space according to pressure of said first fluid above the surface of said metallic substance in said crucible so as to maintain a pressure equilibrium at all times between the inside and the outside of said inner jacket.

2. The low-pressure casting process according to claim 1, wherein the pressure on both sides of said inner jacket decreases below atmospheric pressure to effect a vacuum.

3. The low-pressure casting process according to claim 1, wherein a pressure greater than atmospheric pressure is maintained by the fluids on both sides of said inner jacket between two casting operations in order to hold the liquid metallic substance in the upper part of the injection tube so as to avoid the formation of oxides.

4. The low-pressure casting process according to claim 1, wherein said first fluid and said second fluid are independent fluids of the same physical nature.

5. The low-pressure casting process according to claim 4, wherein said metallic substance includes magnesium, wherein said first fluid is sulphur hexafluoride diluted with a gas selected from the group consisting of air and carbon dioxide, and the said second fluid applied to the other side of the sealed inner jacket is air.

6. A low-pressure casting machine for implementing a low-pressure casting process comprising a sealed outer furnace jacket, a crucible positioned inside said outer jacket for containing a metal substance surrounded by electrical heating elements, refractory and thermally insulated elements wherein said crucible, electrical heating elements, refractory and thermally insulated elements are positioned inside said outer jacket, a lid, a casting nozzle on said lid, and on said lid, a metal inner jacket fixed in a fluid-type manner to a frame of said furnace supporting said crucible and isolating said furnace in a first space in a fluid-tight manner from a second space containing said heating, refractory and insulative elements, means for pressurizing and depressurizing said first space including a first region above the surface of said metal substance in said crucible, means for establishing communication between the second space and a source of pressurized fluid or a vacuum, said means for establishing communication incorporating a valve, and a regulator with a pressure sensor located in said first space and a separate pressure sensor located in said second space connected to said regulator, wherein said regulator is arranged so as to maintain pressure equilibrium between said first space and said second space.

7. The low-pressure casting machine according to claim 6, wherein said metal inner jacket is fixed at the top to an annular lid portion, said annular lid portion fixed to said outer jacket of the furnace for receiving a mobile lid portion, said annular lid portion being provided with passages for establishing communication between the outside of the furnace and the two spaces inside the furnace, said passages being connected by conduits equipped with valve to respective sources of pressurized fluid or vacuum.

8. The low-pressure casting machine according to claim 6, adapted for use with non-permanent molds mobile on rails, comprising a fixed horizontal table above said furnace into which the upper end of a casting nozzle is fixed, rails disposed on either side of said table on which the mobile molds travel, means for displacing said rails in vertical translation so as to apply the bottom orifice of a mold against said casting nozzle, and means for locking said mold support carriage to said table prior to casting.

9. The low-pressure machine according to claim 8, where said means for displacing said rails and vertical translation comprise fixed vertical actuators having piston rods, the ends of said piston rods providing support for the rails, said actuators being controlled synchronously by said regulator device.

10. The low-pressure casting machine according to claim 8, wherein said locking means for said mold support carriage comprise pins movable at right angles to said rails by fixed actuators so as to be inserted into holes formed laterally on at least one side of said fixed table and holes formed in lateral angle arms fastened to said mold support carriage and adapted to be aligned with the corresponding holes in said table when said mold is in the correct position for casting, said actuators being controlled by said regulator device according to the output of sensors fixed to said rails and said table and responsive to the correct position of said carriage.

11. The low-pressure casting machine according to claim 8, wherein the upper end of said casting nozzle is fitted with an annular asbestos washer adapted to be inserted between said nozzle and the mold inlet orifice, said orifice being fitted with projecting conductive spikes inserted in insulative bushings and facing towards said asbestos washer, and being connected by an insulated conductor to said regulator device and adapted, as the mold is lowered, to pass through said asbestos and thereby come into contact with the coductive metal part of said casting nozzle, said conductive metal part of said casting nozzle also being connected to said regulator device, in order to control the lowering of the mold and to initiate the precasting and subsequent casting operations.

12. The low-pressure casting process according to claim 1, wherein said first fluid and said second fluid are independent fluids of different physical natures.

* * * * *

UNITED STATES PATENT AND TRADEMARK OFFICE

CERTIFICATE OF CORRECTION

PATENT NO. : 4,726,414

DATED : February 23, 1988

INVENTOR(S) : Pierre L. MERRIEN

It is certified that error appears in the above-identified patent and that said Letters Patent is hereby corrected as shown below:

At column 1, line 17, change "contianed" to ---contained---.

At column 2, line 37, change "material" to ---materials---.

At column 2, line 44, change "as" to ---has---.

At column 2, line 50, change "in" to ---on---.

At column 4, line 58, insert ---a--- after "is" and before "fixed".

At column 5, line 4, change "symbolicaly" to ---symbolically---.

At column 5, line 5, change "controling" to ---controlling---.

At column 5, line 17, change "controling" to ---controlling---.

At column 6, line 39, change "controled" to ---controlled---.

At column 8, line 20, change "valve" to ---valves---.

At column 8, line 59, change "coductive" to ---conductive---.

Signed and Sealed this

Second Day of May, 1989

*Attest:*

DONALD J. QUIGG

*Attesting Officer*

*Commissioner of Patents and Trademarks*